US006035745A

United States Patent [19]

Kather

[11] Patent Number: 6,035,745

[45] Date of Patent: Mar. 14, 2000

[54] INDEXING CLUTCH ASSEMBLY FOR GEAR WRENCH

[76] Inventor: Scott D. Kather, 1861 Glenfield Dr., Ortonville, Mich. 48462

[21] Appl. No.: 09/176,406

[22] Filed: Oct. 20, 1998

[51] Int. Cl.[7] ..... B25B 21/00

[52] U.S. Cl. ..... 81/57.13; 81/57.29; 81/58.2

[58] Field of Search ..... 81/57.13, 57.29, 81/58.2

[56] References Cited

U.S. PATENT DOCUMENTS

| | | |
|---|---|---|
| 881,346 | 3/1908 | Sargent . |
| 1,050,583 | 1/1913 | Whitney . |
| 1,200,430 | 10/1916 | Rosenstein . |
| 2,550,010 | 4/1951 | Kavalar . |
| 2,730,000 | 1/1956 | Crittenden, Jr. . |
| 3,535,960 | 10/1970 | Borries . |
| 3,620,105 | 11/1971 | Batten . |
| 4,506,567 | 3/1985 | Makhlouf . |
| 4,574,665 | 3/1986 | Blachly . |
| 5,022,505 | 6/1991 | Io . |
| 5,050,463 | 9/1991 | Stielow . |
| 5,339,710 | 8/1994 | Deadmond et al. . |
| 5,355,751 | 10/1994 | Specht . |
| 5,406,866 | 4/1995 | Badiali . |
| 5,460,062 | 10/1995 | Wilson, Jr. . |
| 5,522,285 | 6/1996 | Wilson, Jr. et al. . |
| 5,522,286 | 6/1996 | Wilson, Jr. et al. . |
| 5,537,897 | 7/1996 | Wilson, Jr. . |
| 5,544,553 | 8/1996 | Galat . |
| 5,697,266 | 12/1997 | Wilson, Jr. . |

OTHER PUBLICATIONS

The Torrington Company, Service Catalog, Drawn Cup Roller Clutches, 4 pgs. copyr. 1988.

INA Bearing Company, Inc. Catalog #305, Drawn Cup Roller Clutches, 3 pgs. copyr. Oct. 1990.

*Primary Examiner*—James G. Smith

*Attorney, Agent, or Firm*—Harness, Dickey & Pierce

[57] ABSTRACT

An improved gear wrench is disclosed having an indexing clutch assembly operably coupling an output shaft with a gear assembly. The indexing clutch assembly includes a rotor, a freewheeling mechanism rotatably coupling the rotor to a drive shaft, a stator, and an indexing mechanism operably coupling the stator to the drive shaft. The freewheeling mechanism provides driving engagement of the rotor and the drive shaft in a first direction and freewheeling or relative rotation therebetween in a second direction. The indexing mechanism appropriately positions the drive shaft in a predetermined indexing position when rotated in a second direction and prevents further rotation thereat. The present invention further includes an angular adjustment mechanism for adjusting the indexing position of the drive shaft relative to the indexing clutch housing.

21 Claims, 3 Drawing Sheets

INDEXING CLUTCH ASSEMBLY FOR GEAR WRENCH

TECHNICAL FIELD

The present invention generally relates to an improved gear wrench of the type used for driving tube nuts, and more particularly to a gear wrench having an indexing clutch assembly to appropriately position the socket gear for removal of the gear wrench.

BACKGROUND OF THE INVENTION

Gear wrenches, also known as off-set drivers or nut runners, are well known in the industry and typically are used for driving threaded fasteners in height-limited environments (e.g., where a threaded stud is positioned directly adjacent to a flange) or alternately where the end of an elongated tube or pipe line is secured with a threaded fastener. To provide access to the threaded fastener, the gear wrench is provided with a slotted socket gear which readily permits placement of the gear wrench onto the threaded fastener.

For example, U.S. Pat. No. 3,620,105 discloses such an off-set driver in which a socket gear is rotatably supported within a driver housing which is provided with a slot. A complementary slot formed in the socket gear is aligned with the slot formed in the driver housing such that the driver may be applied laterally to the nut without requiring axial shifting of the nut and the socket, thereby enabling engagement of the gear wrench onto a tube nut in a clearance limited environment. After performing a tightening operation, the gear wrench is removed from the nut. However, the slots formed in the socket gear and the housing must be realigned to enable removal of the gear wrench from the threaded fastener or tubing. In this regard, the gear wrench is driven in a reverse direction until the complementary slots are aligned.

However, obtaining precise alignment of the slots formed in the socket gear and gear wrench housing can be difficult and time consuming when no means for achieving alignment is employed. More specifically, precise manual control of the gear wrench may at times be difficult such that precise alignment is not achieved.

Various means for achieving alignment have also been developed. In this regard, U.S. Pat. Nos. 5,460,062 and 5,544,553 disclose a gear wrench in which a pin engages a cut out section of the drive gear in order to align the driving gear, and hence the socket gear, in an appropriate position when the slot of the socket gear is aligned with the opening in the housing. Alternately, as disclosed in U.S. Pat. No. 5,339,710, a pivoting stop arm may be utilized to engage a detent formed in the drive cam gear to place the slot in alignment with the housing. Many of these methods utilize a "hard stop" positioning mechanism which has the disadvantage of overly stressing the drive gear when the positioning mechanism engages. Repeated use of such a gear wrench results in damage and possibly failure of the drive gear assembly. Furthermore, a phenomenon referred to as "bounce back" may occur in which the sudden engagement of the hard stop causes the socket gear to rotate slightly forwardly, thereby misaligning the socket gear slot and the gear housing slot.

In an effort to overcome these disadvantages, manufacturers have employed gear wrenches which utilize a soft reverse motor, whereby the rearward driving torque is substantially less than the forward driving torque. More specifically, the torque generated by the gear wrench in a reverse direction is substantially less than the torque generated in the forward direction. However, the incorporation of a soft reverse feature into the drive head adds cost and complexity to the gear wrench motor. Furthermore, the soft reverse motor limits the use of the drive head to tube nut applications such that the drive head cannot be used for torque check or disassembly functions which require driving torque in a reverse direction.

SUMMARY OF THE INVENTION

In accordance with the principles of the present invention, an improved gear wrench and an indexing clutch assembly therefor is disclosed. The improved gear wrench includes a drive head, an indexing clutch assembly having an input operably coupled to the drive head and an output operably coupled to a gear assembly having a slotted socket gear and a slotted housing. The indexing clutch assembly is a positionable clutch assembly which is operable to couple the output shaft of the drive head with the input gear of the gear assembly when the drive head is driven in a first direction and operable to disengage the output of the drive head from the input gear of the gear assembly when the socket gear slot is aligned with the housing slot and the drive head is driven in a second reverse direction.

The indexing clutch assembly includes a rotor operably coupled to the output shaft of the drive head, a drive shaft operably coupled for rotation with the rotor and a stator operably coupled to the drive shaft. A freewheeling mechanism is interconnected between the rotor and the drive shaft and operable in an engaged mode to provide concurrent rotation of the drive shaft and the rotor in a first direction and further operable in a disengaged mode to permit relative movement therebetween in a second direction. An indexing mechanism is interconnected between the drive shaft and the stator and operable in a non-actuated mode to permit relative rotation between the drive shaft and the stator in the first direction and further operable in an actuated mode to prevent rotational movement between the drive shaft and the stator once the drive shaft reaches a predetermined indexing position, whereby the slot formed in the socket gear is in alignment with the slot formed in the gear housing. Further relative rotation in the second direction between the rotor and the drive shaft is permitted by the freewheeling mechanism. An angular adjustment mechanism is provided for adjusting the positioning of the indexing mechanism relative to the clutch housing such that precise alignment of the socket gear slot and housing slot can be achieved.

It is a principle object of the present invention to provide an improved gear wrench and an indexing clutch assembly therefor which is efficiently operable for driving a nut in a first direction and freewheeling in a second direction until the gear wrench is properly aligned for removal from the nut.

It is another object of the present invention to provide a clutch assembly having an indexing mechanism therein which reduces the thickness of the gear assembly, thereby improving the positionability of the gear wrench into height-limited environments.

It is a further object of the present invention to provide an indexing clutch assembly which eliminates the hard impact stopping of the gear assembly when the gear wrench is reversed to bring the slotted gear to its indexed position.

It is yet another object of the present invention to eliminate the need for a soft reverse gear wrench by providing a freewheeling clutch feature.

It is still another object of the present invention to provide an angular adjustment mechanism for the socket gear stop position such that aligning and fine tuning of the relative position between the slotted socket gear and the slotted housing can be achieved.

It is still a further object of the present invention to provide a gear wrench in which various socket gears can be utilized without requiring modification or replacement of the other gears in the gear assembly.

These and other objects, features and advantages of the present invention will become apparent from the following detailed description when viewed in accordance with the accompanying drawings and appended claims.

BRIEF DESCRIPTION OF THE DRAWINGS

FIG. 4 is an exploded detailed view of the indexing clutch assembly and gear assembly of the present invention for driving a right hand threaded fastener;

DETAILED DESCRIPTION OF THE INVENTION

Figure 1:
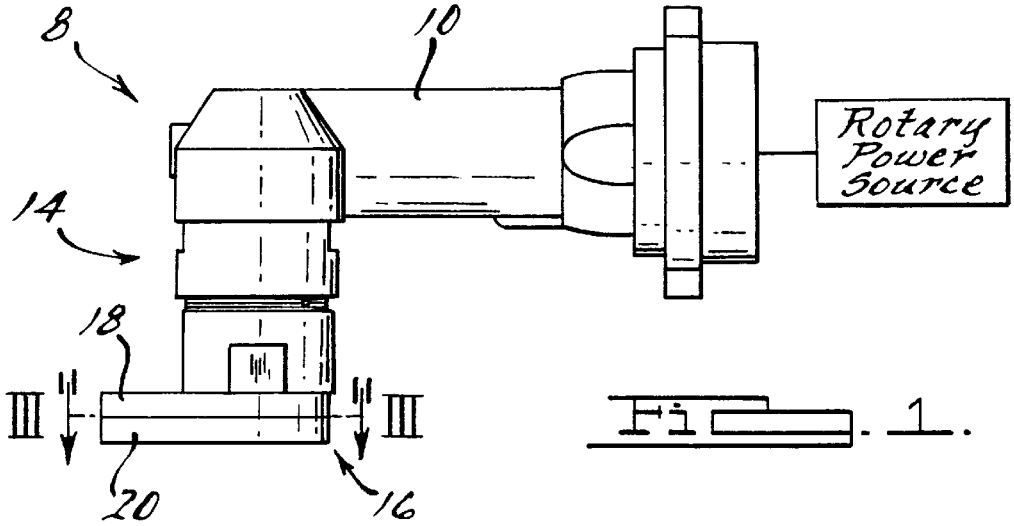
FIG. 1 is an elevational view of a gear wrench of the present invention having an indexing clutch assembly operably coupling the drive head and the gear assembly.
Figure 2:
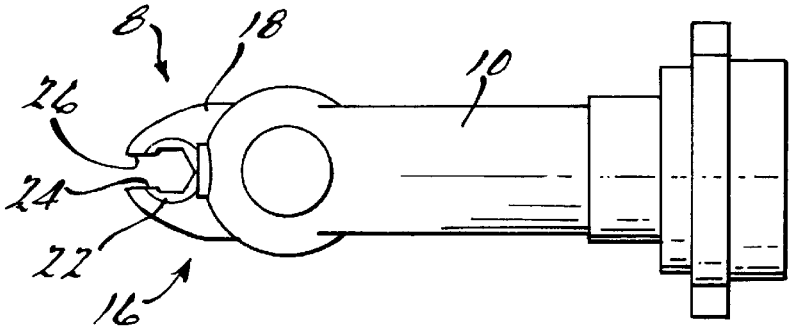
FIG. 2 is a plan view of the gear wrench illustrated in FIG. 1.
Figure 3:
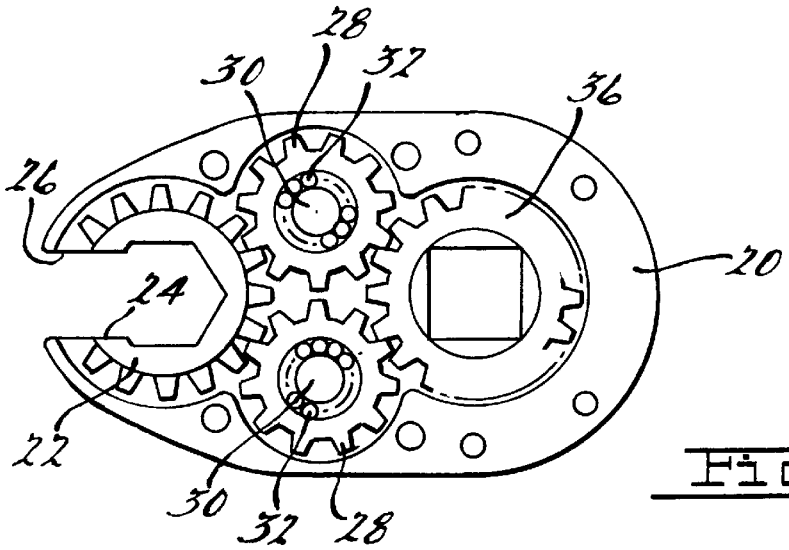
FIG. 3 is a cross-sectional view taken along line III—III illustrated in FIG. 1 showing the gear assembly of the gear wrench.
Figure 1:
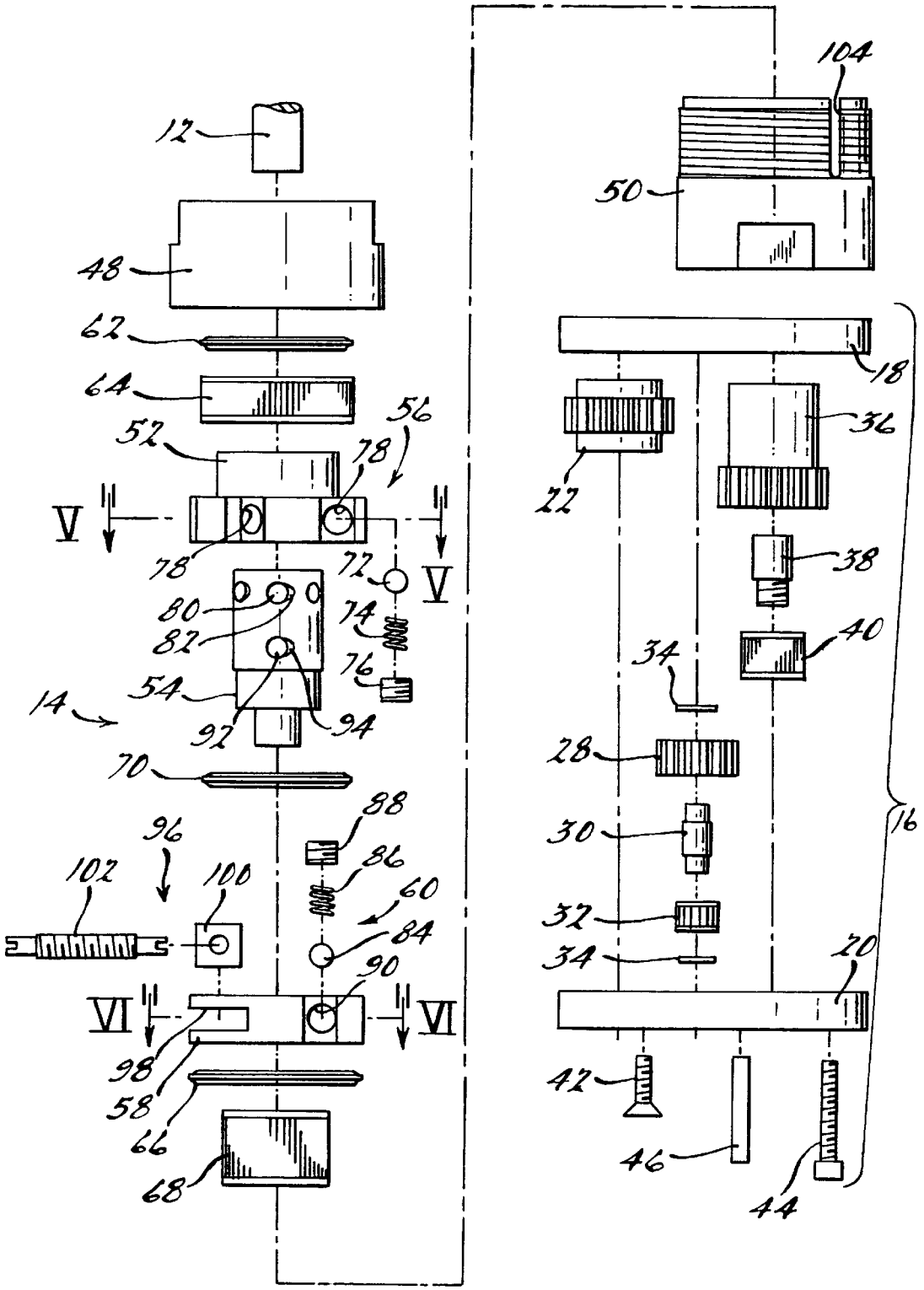

With reference to the figures and in accordance with the teachings of the present invention, gear wrench 8 is of the type operably coupled to a power supply for providing rotary power through a drive shaft. Gear wrench 8 includes drive head 10 which transfers the rotary power from a source through a ninety degree (90°) angle to an output shaft 12. An indexing clutch assembly 14 is operably coupled to the output shaft of drive head 10 at an input side thereof. The output side of indexing clutch assembly 14 is operably coupled to an input side of gear assembly 16 which rotatably drives socket gear 22. More specifically, as best seen in FIG. 3, gear assembly 16 includes socket gear 22 rotatably coupled to drive gear 36 through a pair of idler gears 28 which are supported for rotation within upper and lower gear housing 18, 20 on idler pin 30 and needle bearings 32. Socket gear 22 has a slot 24 formed therein which is complementary to slot 26 formed in upper and lower gear housings 18, 20 to facilitate placement of gear wrench 8 on a threaded fastener. More specifically, socket gear slot 24 is rotatably positionable within gear assembly 16 so as to align with gear housing slot 26, thereby enabling lateral positioning of gear wrench 8 into engagement with a threaded fastener. As best seen in FIG. 4, idler gear 28 is also rotatably supported within upper and lower gear housing 18, 20 by a pair of thrust races 34 disposed on opposite sides of idler gear 28. Similarly, drive gear 36 is rotatably supported on drive pin 38 by needle bearing 40. Gear assembly 16 is secured together by screw 42. Similarly, gear assembly 16 is relatively positioned and secured to indexing clutch assembly 14 by way of screw 44 and dowel pin 46.

Gear wrench 8 also includes indexing clutch assembly 14 having upper clutch housing 48 and lower clutch housing 50 rotatably supporting rotor 52 and drive shaft 54. Freewheeling mechanism 56 interconnects rotor 52 and drive shaft 54. Freewheeling mechanism 56 is operable in an engaged mode to provide concurrent rotation of rotor 52 and drive shaft 54 in a first direction and a disengaged mode to permit relative rotation or freewheeling therebetween in a second direction. Stator 58 is disposed within lower clutch housing 50 and is interconnected to drive shaft 54 through indexing mechanism 60. Indexing mechanism 60 is operable in a non-actuated mode to permit relative rotation or freewheeling between drive shaft 54 and stator 58 in a first direction and an actuated mode to permit limited relative rotation of drive shaft 54 within stator 58 in a second direction until drive shaft 54 reaches a predetermined indexing position, at which point indexing mechanism 60 selectively engages drive shaft 54 to prevent further relative rotation in the second direction. In this manner, indexing clutch assembly 14 operably couples the output of drive head 10 to the input of gear assembly 16 such that socket gear 22 is fully driveable in a first, tightening direction and selectively driveable in a second, indexing direction until socket gear slot 24 is aligned with gear housing slot 26 for facilitating removal of gear wrench 8.

With continued reference now to FIG. 4, indexing clutch assembly 14 includes a plurality of bearing assemblies for rotatably supporting the internal components of clutch assembly 14. More specifically, upper thrust bearing 62 and upper needle bearing 64 are disposed within upper clutch housing 48 and engage and rotatably support rotor 52 therein. Similarly, lower thrust bearing 66 and lower needle bearing 68 are disposed within lower housing 50 and engage bearing surfaces formed on stator 58 and drive shaft 54, respectively. In addition, intermediate thrust bearing 70 is operably disposed between stator 58 and rotor 52 for providing a bearing surface therebetween. In this way, rotor 52 and drive shaft 54 are supported for relative rotation within upper and lower clutch housings 48, 50.

Figure 5:
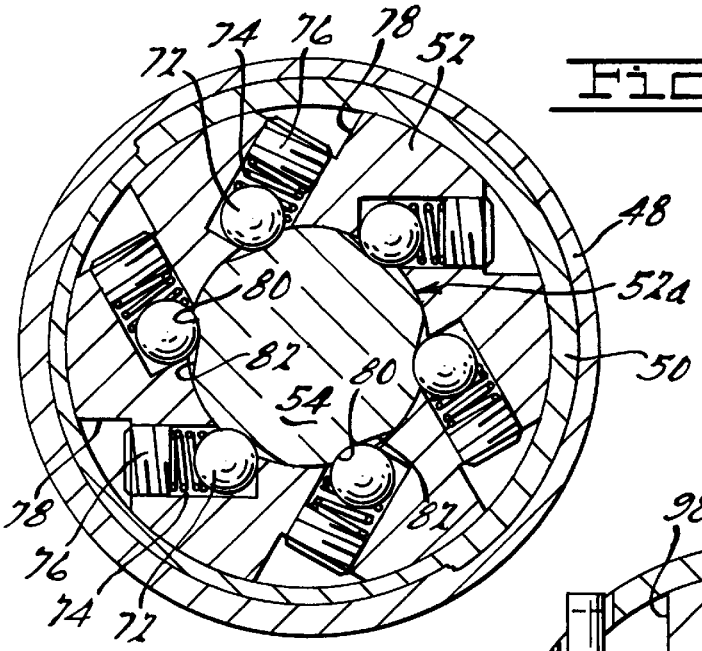
FIG. 5 is a cross-sectional view taken along line V—V illustrated in FIG. 4 showing the freewheeling mechanism of the present invention.

With particular reference now to FIG. 5, freewheeling mechanism 56 of the present invention will be described in greater detail. As previously described, freewheeling mechanism 56 operably couples rotor 52 with drive shaft 54 to permit concurrent rotation therebetween in a first rotational direction and freewheeling rotation therebetween in a second rotational direction. More specifically, freewheeling mechanism includes a plurality of spring-biased ball detents extending from an inner circumferential surface 52*a* of rotor 52 to operably engage spherical indents 80 formed in drive shaft 54. Rotor 52 has a plurality of apertures 78 formed therein which extend radially inwardly in a counter-clockwise direction. Each ball detent includes a ball bearing 72 and a compression coil spring 74 disposed in aperture 78. As presently preferred, aperture 78 is threaded to receive a threaded spring seat 76 operably disposed therein.

As presently preferred, six detent mechanisms are equidistantly spaced around the circumference of rotor 52 and extend past the inner surface 52*a* defined thereby. The upper portion of drive shaft 54 is formed with complementary spherical indents 80 having a tapered trailing portion 82 extending in a counter-clockwise direction. Thus, the configuration of spherical indent 80, trailing portion 82, as well as the size of ball bearing 72 and the spring rate of compression spring 74 combine to form a freewheeling mechanism. More specifically, as rotor 52 is driven an a clockwise direction (as illustrated in FIG. 5), spherical indent 80 formed on drive shaft 54 engages ball bearing 72 for rotatably coupling rotor 52 with drive shaft 54. Conversely, when rotor 52 is rotated in a counter-clockwise direction (as illustrated in FIG. 5), trailing portion 82 urges ball bearing 72 back against compression spring 74 allowing ball bearing 72 to move out of engagement with drive shaft 54, thereby permitting relative counter-clockwise rotation of rotor 52 with respect to drive shaft 54.

Figure 6:
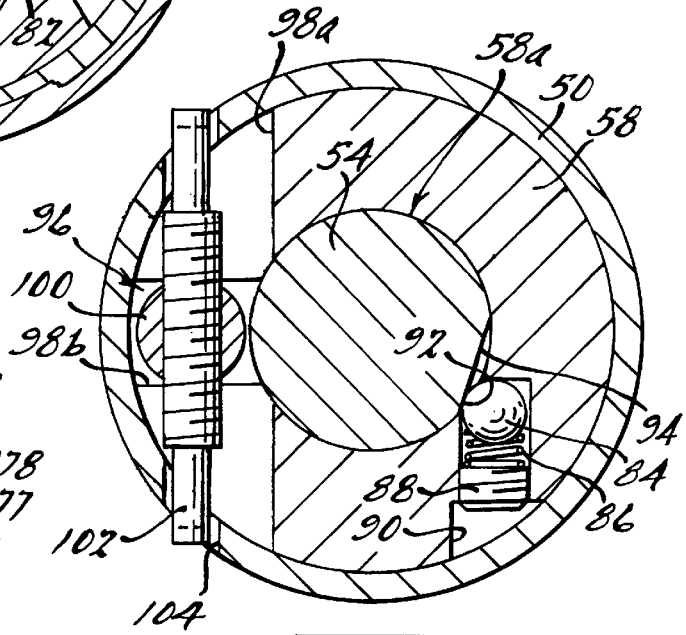
FIG. 6 is a cross-sectional view taken along line VI—VI illustrated in FIG. 4 showing the indexing mechanism and angular adjustment mechanism of the present invention.

With particular reference now to FIG. 6, indexing mechanism 60 will be described in greater detail. Indexing mechanism 60 operates under the same principle as freewheeling mechanism 56 with the exception that only one spring-biased ball detent is utilized for locating the indexing position of drive shaft 54 with respect to stator 58. Stator 58 has a threaded aperture 90 formed therein which extends in a counter-clockwise, radially-inward direction. The ball detent of indexing mechanism 60 includes ball bearing 84, compression coil spring 86 and threaded spring seat 88 disposed within threaded aperture 90 such that a portion of ball bearing 84 extends past an inner circumferential surface 58*a* of stator 58. As with the freewheeling mechanism, a circumferential band could be employed to retain ball bearing 84 in aperture 90.

A complementary spherical indent 92 and tapered trailing portion 94 extending in a counter-clockwise direction are formed on a lower portion of drive shaft 54. Thus, when rotor 52 and drive shaft 54 are rotatably driven in a clockwise direction (as illustrated in FIG. 6) ball bearing 84 is permitted to move out of engagement with indent 92 as a result of spring 86 and trailing portion 94. However, when rotated in a counter-clockwise direction (as illustrated in FIG. 6), drive shaft 54 is permitted to rotate only to the point at which ball 84 engages indent 92 at which point further relative rotation therebetween is prevented. At this point, indexing mechanism 60 has appropriately positioned drive shaft 54 in a preselected indexing position relative to stator 58 and lower clutch housing 50. In this way, indexing mechanism 60 of indexing clutch assembly 14 may be utilized to appropriately position socket gear slot 24 relative to gear housing slot 26.

With continued reference to FIG. 6, the present invention further provides means for adjusting the angular alignment of stator 58 with respect to lower housing 50. More specifically, angular adjustment mechanism 96 is disposed within a tangential slot 98*a* and a radial slot 98*b* formed in stator 58 and functions to angularly position stator 58 with respect to lower housing 50, thereby adjusting the indexing position defined by the relative angular relationship of drive shaft 54 and indexing clutch assembly 14. In a first embodiment, angular adjustment mechanism 96 includes adjustment pin 100 disposed within slots 98*a*, 98*b* and threaded adjustment screw 102 extending through adjustment pin 100 which provides approximately forty-five degrees (45°) of angular adjustment. Adjustment pin slot 104 is formed in lower housing 50 to provide access to adjustment screw 102.

Angular adjustment mechanism 96 rotatably positions stator 58, and thus indexing mechanism 60 relative to lower housing 50 by appropriately turning adjustment screw 102. For example, as adjustment screw 102 is rotated in a clockwise direction drive adjustment pin 100 is driven downwardly (as illustrated in FIG. 6) along the longitudinal axis of adjustment screw 102 causing stator 58 to rotate counter-clockwise with respect to lower housing 50. The cylindrical configuration of adjustment pin 100 permits rotation within slots 98*a*, 98*b* such that angular adjustment mechanism 96 does not bind within indexing clutch assembly 14. Similarly, counter-clockwise rotation of adjustment screw 102 urges drive pin 100 upwardly (as illustrated in FIG. 6) causing stator 58 to move clockwise relative to lower clutch housing 50. The incorporation of angular adjustment mechanism 96 provides the necessary adjustment capabilities to permit the substitution of multiple socket gears having varying drive sizes requiring a different slot size, and thus different angular orientation for alignment with gear housing slot 26, without requiring complete replacement of gear assembly 16.

Referring now to all the drawings, the operation of indexing clutch assembly 14 will now be described. Gear wrench 8 is energized causing output shaft 12 thereof to rotate rotor 52 in a forward, clockwise direction. Ball bearing 72 of freewheeling mechanism 56 engages spherical indent 80 of drive shaft 54 to couple and transmit rotational energy from rotor 52 to drive shaft 54, drive gear 36, idler gears 28 and socket gear 22. Indexing mechanism 60 permits relative rotational movement of drive shaft 54 with respect to stator 58. When a nut driven by gear wrench 8 reaches its tightened position, gear wrench 8 is removed from the nut, but typically cannot be removed from the threaded fastener due to limited clearance and misalignment of socket gear slot 24 and housing slot 26. Gear wrench 8 is then driven in a reverse, counter-clockwise direction, freewheeling mechanism 56 provides sufficient rotational coupling between rotor 52 and drive shaft 54 to rotate drive shaft 54 in a counter-clockwise direction until indexing mechanism 60 engages spherical indent 92 at which point drive shaft 54 has reached the predetermined indexing position where socket gear slot 24 is aligned with housing slot 26. Freewheeling mechanism 56 then permits rotor 52 to continue counter-clockwise rotation while maintaining drive shaft 54 in a fixed angular position such that socket gear slot 24 remains aligned with gear housing slot 26. In this way, freewheeling mechanism 56 eliminates the need for a soft-reverse drive head.

Figure 7:
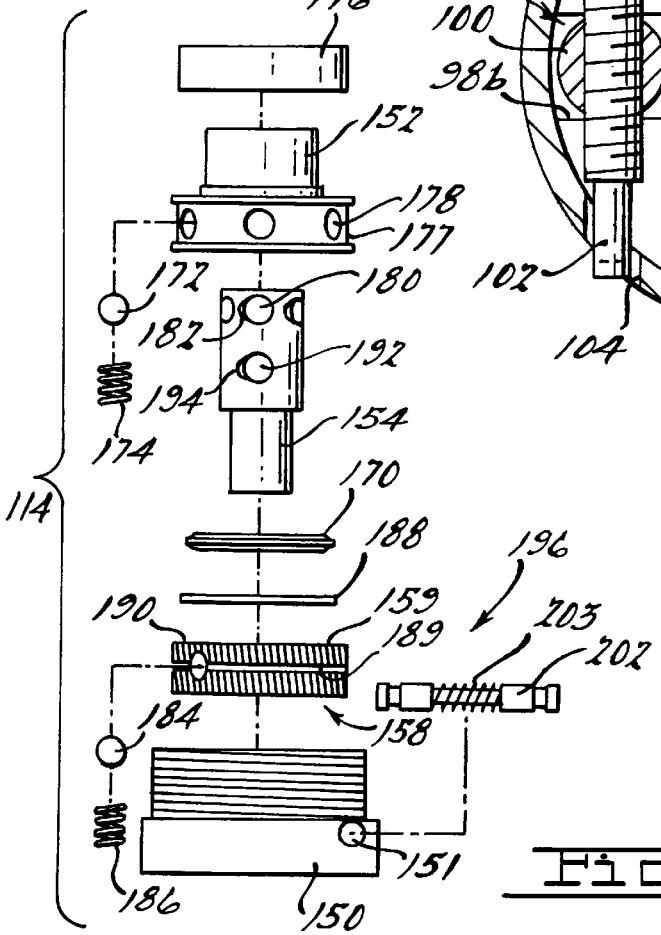
FIG. 7 is an alternate embodiment of the present invention illustrating a portion of the indexing clutch assembly for driving a left hand threaded fastener.

Referring now to FIG. 7, an alternate preferred embodiment of the present invention is illustrated. Similar components of the alternate preferred embodiment are designated by reference numerals incremented by a factor of one hundred (100). The components of indexing clutch assembly 114 have been modified to provide forward rotational driving of drive shaft 154 in a counter-clockwise direction. More specifically, rotor 152 has a plurality of apertures 178 formed therein which extend radially inwardly in a clockwise direction which is opposite the radial orientation of threaded apertures 78 formed on rotor 52. Similarly, the trailing portions 182, 194 extend in a clockwise direction from spherical indents 180, 192 on drive shaft 154. Likewise, the aperture 190 formed in stator 158 extends in a clockwise radially inward direction as opposed to threaded aperture 90 formed in stator 58. In this manner, the components of indexing clutch assembly 114 are configured to rotatably drive a gear assembly in a counter-clockwise direction, while freewheeling with respect to the gear assembly in a clockwise direction.

In the alternate preferred embodiment illustrated in FIG. 7, expandable members are used to retain ball bearings 172, 184 and compression springs 174 and 186 in apertures 178 and 190, in place of threaded spring seats 76 and 88, respectively. More specifically, expandable retaining band 176 is disposed on a circumferential surface of rotor 152 having a locally reduced diameter portion 177. Retaining band 176 permits reciprocating movement of ball bearing 172 within rotor 152 while retaining compression spring 174 and ball bearing 172 in aperture 178. Similarly, expandable retaining ring 188 is disposed in a circumferential groove 189 formed in stator 158. Retaining ring 188 permits reciprocating movement of ball bearing 184 within stator 156 while retaining compression spring 186 and ball bearing 184 in aperture 190.

The alternate preferred embodiment illustrated in FIG. 7 further includes means for adjusting the angular alignment of stator 158 with respect to lower housing 150 which differs structurally from angular adjustment mechanism 96. More specifically, a helical gear segment 159 is formed on the outer circumference of stator 158. Adjustment screw 202 is disposed in aperture 151 formed in lower housing 150 and rotatably supported therein. A worm gear segment 203 is formed on adjustment screw 202 and meshingly engages helical gear segment 159. As such, rotation of adjustment screw 202 drivingly rotates stator 158 relative to lower housing 150, thereby providing three hundred and sixty degrees (360°) of angular adjustment.

One skilled in the art will readily recognize that the operation of the freewheeling mechanism and the indexing mechanism can be adjusted for the appropriate torque requirements of any given gear wrench by modifying the size of the ball bearings utilized, as well as modifying depth of spherical indents and the tapered profile of trailing portions. From the foregoing detailed description, one skilled in the art will readily recognize that the present invention provides an improved gear wrench and an indexing clutch assembly therefor which permits precise alignment of the socket gear slot and the gear housing slot for facilitating use of such a gear wrench. Moreover, the indexing clutch assembly provides a freewheeling mechanism which eliminates the need for using a gear wrench having a soft reverse feature. Furthermore, the present invention provides an indexing mechanism which does not impose high impact loads on the gear wrench when appropriately positioned. While the present invention has been disclosed by describing and illustrating various exemplary embodiments, one skilled in the art would recognize that the present invention has utility in other applications which require full power transmission in a forward direction and reduced power transmission and indexing capabilities in a second direction. From the foregoing disclosure, those skilled in the art will readily recognize from the foregoing description and the accompanying drawings and claims that various changes, modifications and variations can be made herein without departing from the spirit and scope of the invention as defined in the following claims.

What is claimed is:

1. A gear wrench comprising:

a drive head having an output shaft;

an indexing clutch assembly including a rotor operably coupled to said output shaft, a drive shaft, a freewheeling mechanism interconnecting said rotor and said drive shaft and operable in an engaged mode to provide concurrent rotation of said rotor and said drive shaft in a first direction and a disengaged mode to permit relative rotation therebetween in a second direction, a stator, and an indexing mechanism interconnecting said drive shaft and said stator and operable in a non-actuated mode to permit relative rotation between said drive shaft and said stator in said first direction and an actuated mode to permit limited relative rotation between the drive shaft and the stator in said second direction until said drive shaft reaches a predetermined indexing position at which point said indexing mechanism selectively engages said drive shaft to prevent further relative rotation in said second direction; and a gear assembly including a gear housing having a gear housing slot formed therein, a drive gear supported for rotation in said gear housing and operably coupled to said drive shaft, a socket gear supported for rotation in said gear housing and having a slot formed therein, and an idler gear supported for rotation in said gear housing and operably coupling said drive gear and said socket gear, said socket gear slot being aligned with said gear housing slot when said drive shaft is in said predetermined indexing position.

2. The gear wrench of claim 1 wherein said freewheeling mechanism comprises a ball detent mechanism disposed within said rotor and an indent formed in said drive shaft, said ball detent mechanism engaging said indent to provide concurrent rotation of said rotor and said drive shaft in said first direction, and said ball detent mechanism disengaging said indent to permit relative rotation of rotor and said drive shaft in said second direction.

3. The gear wrench of claim 2 wherein said freewheeling mechanism further comprises a radially-inward aperture formed in said rotor, said aperture having a ball and a spring operably disposed therein.

4. The gear wrench of claim 2 wherein said freewheeling mechanism further comprises a plurality of radially-inward apertures formed in said rotor, each of said apertures having a ball and a spring operably disposed therein.

5. The gear wrench of claim 2 wherein said indent formed in said drive shaft includes a spherical indent portion and a tapered trailing portion.

6. The gear wrench of claim 1 wherein said indexing mechanism comprises a ball detent mechanism disposed within said stator and an indexing indent formed in said drive shaft, said ball detent mechanism operable for engaging said indexing indent to prevent relative rotation between said drive shaft and said stator in said second direction.

7. The gear wrench of claim 6 wherein said indexing mechanism further comprises a radially-inward aperture formed in said stator, said aperture having a ball and a spring operably disposed therein.

8. The gear wrench of claim 6 wherein said indexing indent formed in said drive shaft includes a spherical indent portion and a tapered trailing portion.

9. The gear wrench of claim 1 further comprising an angular adjustment mechanism operably coupled to said stator for angularly positioning said stator relative to said gear housing.

10. The gear wrench of claim 9 wherein said angular adjustment mechanism comprises a threaded adjustment screw operably coupled to a threaded portion formed in said stator.

11. An indexing clutch assembly for a gear wrench of the type having a slotted socket gear rotatably supported in a slotted gear housing, the indexing clutch assembly comprising:

a clutch housing;

a rotor supported for rotational movement in said clutch housing;

a drive shaft supported for rotational movement in said clutch housing;

a freewheeling mechanism interconnecting said rotor and said drive shaft and operable in an engaged mode to provide concurrent rotation of said rotor and said drive shaft in a first direction and further operable in a disengaged mode to permit relative rotation therebetween in a second direction;

a stator; and an indexing mechanism interconnecting said drive shaft and said stator and operable in a non-actuated mode to permit relative rotation between said drive shaft and said stator in said first direction and further operably in an actuated mode to permit limited relative rotation between the drive shaft and the stator in said second direction until said drive shaft reaches a predetermined indexing position at which point said indexing mechanism selectively engages said drive shaft to prevent further relative rotation in said second direction.

12. The gear wrench of claim 11 wherein said freewheeling mechanism comprises a ball detent mechanism disposed with said rotor and a indent formed in said drive shaft, said ball detent mechanism engaging said indent to provide concurrent rotation of said rotor and said drive shaft in said first direction, and said ball detent mechanism disengaging said indent to permit relative rotation of rotor and said drive shaft in said second direction.

13. The gear wrench of claim 12 wherein said freewheeling mechanism further comprises a radially-inward aperture formed in said rotor, said aperture having a ball and a spring operably disposed therein.

14. The gear wrench of claim 12 wherein said freewheeling mechanism further comprises a plurality of radially-inward apertures formed in said rotor, each of said apertures having a ball and a spring operably disposed therein.

15. The gear wrench of claim 12 wherein said indent formed in said drive shaft includes a spherical indent portion and a tapered trailing portion.

16. The gear wrench of claim 11 wherein said indexing mechanism comprises a ball detent mechanism disposed within said stator and an indexing indent formed in said drive shaft, said ball detent mechanism operable for engaging said indexing indent to prevent relative rotation between said drive shaft and said stator in said second direction.

17. The gear wrench of claim 16 wherein said indexing mechanism further comprises a radially-inward aperture formed in said stator, said aperture having a ball and a spring operably disposed therein.

18. The gear wrench of claim 16 wherein said indexing indent formed in said drive shaft includes a spherical indent portion and a tapered trailing portion.

19. The gear wrench of claim 11 further comprising an angular adjustment mechanism operably coupled to said stator for angularly positioning said stator relative to said gear housing.

20. The gear wrench of claim 19 wherein said angular adjustment mechanism comprises a threaded adjustment screw operably coupled to a threaded portion formed in said stator.

21. A gear wrench comprising:

a drive head having an output shaft;

an indexing clutch assembly including:

a clutch housing;

a rotor operably coupled to said output shaft and supported for rotation in said clutch housing;

a drive shaft supported for rotation in said clutch housing;

a freewheeling mechanism including a first ball detent mechanism disposed within said rotor and a first indent formed in said drive shaft, said first ball detent mechanism engaging said first indent to provide concurrent rotation of said rotor and said drive shaft in a first direction, and said first ball detent mechanism disengaging said first indent to permit relative rotation of rotor and said drive shaft in said second direction;

a stator;

an indexing mechanism including a second ball detent mechanism disposed within said stator and a second indent formed in said drive shaft, said ball detent mechanism operable for engaging said second indent to prevent relative rotation between said drive shaft and said stator in said second direction when said drive shaft is in a predetermined indexing position at which point said indexing mechanism selectively engages said drive shaft to prevent further relative rotation in said second direction; and an angular adjustment mechanism operably coupled to said stator for angularly positioning said stator relative to said clutch housing; and a gear assembly including a gear housing having a gear housing slot formed therein, a drive gear supported for rotation in said gear housing and operably coupled to said drive shaft, a socket gear supported for rotation in said gear housing and having a slot formed therein, and an idler gear supported for rotation in said gear housing and operably coupling said drive gear and said socket gear, said socket gear slot being aligned with said gear housing slot when said drive shaft is in said predetermined indexing position.

* * * * *